US005525747A

United States Patent [19]

Hsu et al.

[11] Patent Number: 5,525,747

[45] Date of Patent: Jun. 11, 1996

[54] MUSIC BOX HAVING DUAL SETS OF ORNAMENT MOVING ELEMENTS

[76] Inventors: Feng-Hsiang Hsu, Fl. 7, No. 9, Lane 11, Ho Chiang St.; Ching-Fa Huang, FL. 2, No. 4, Lane 90, Sec. 1, Chih Yuan I Rd., both of Taipei, Taiwan

[21] Appl. No.: 49,358

[22] Filed: Apr. 21, 1993

[51] Int. Cl.[6] ..... G10F 1/06; G09F 27/00; A63H 3/28

[52] U.S. Cl. ..... 84/95.2; 446/298; 40/455

[58] Field of Search ..... 84/94.1, 94.2, 84/95.1, 95.2; 446/297, 298; D17/24; 40/455

[56] References Cited

U.S. PATENT DOCUMENTS 5,070,753 12/1991 Hou ..... 84/95.2

5,339,923 8/1994 Chen ..... 84/95.2

*Primary Examiner*—Cassandra C. Spyrou

*Attorney, Agent, or Firm*—Bacon & Thomas

[57] ABSTRACT

Disclosed is a music box including a first mechanism driven by a clock-work and a gear on a pinned barrel actuated by the clock-work to swing or rotate a first set of ornamental moving elements, and a second moving mechanism driven by the shaft of the pinned barrel to swing, rock, reciprocate, oscillate, push and pull, or rotate a second set of ornamental moving elements.

4 Claims, 5 Drawing Sheets

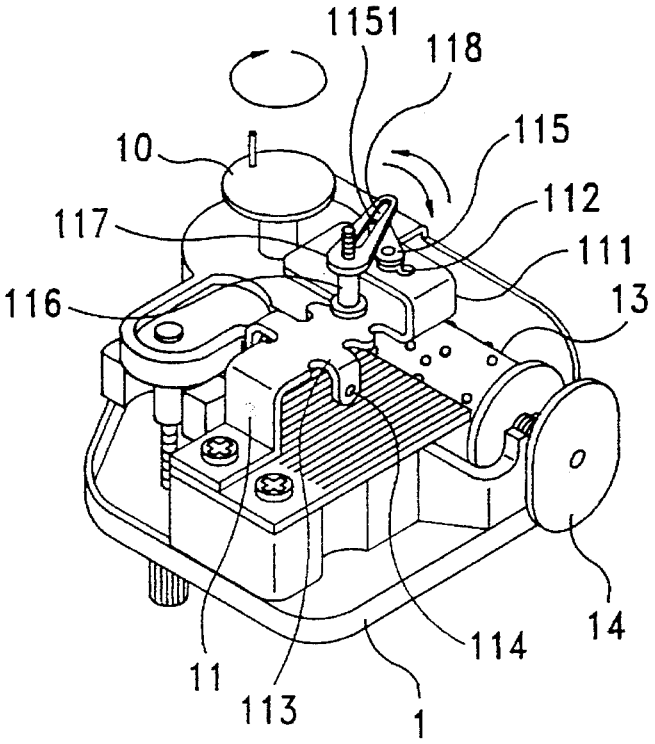
FIG. 1A
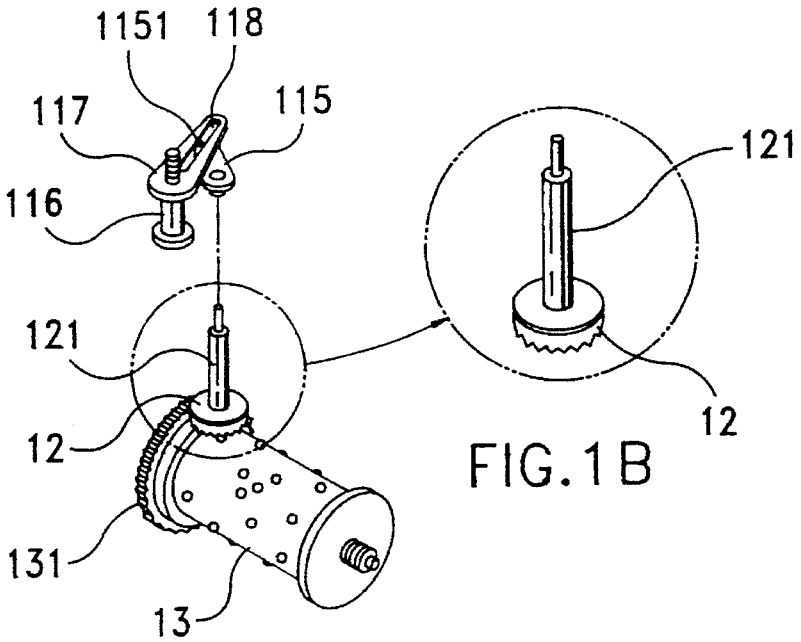
FIG. 1B
FIG. 1

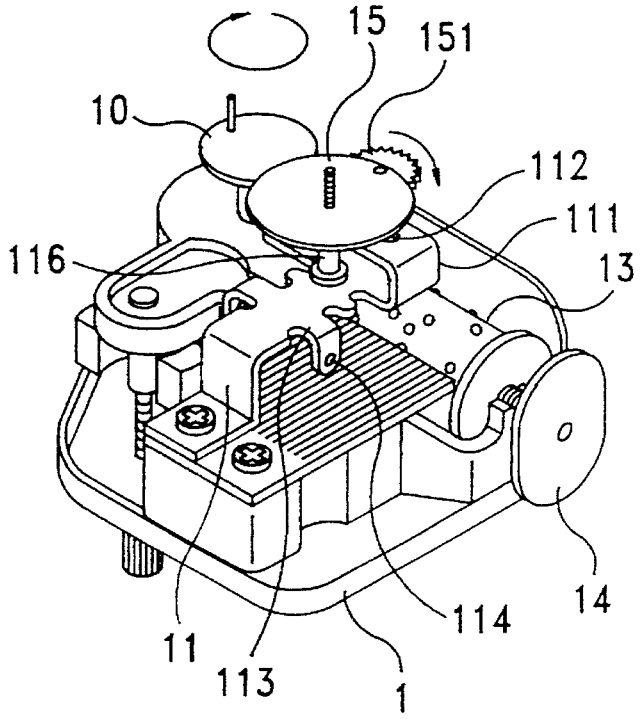
FIG.2A
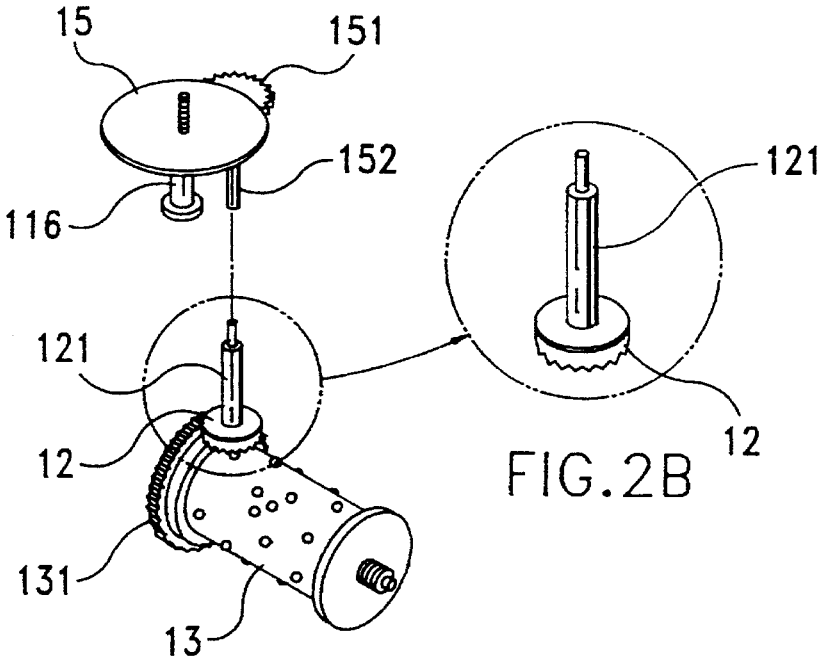
FIG.2B
FIG. 2

MUSIC BOX HAVING DUAL SETS OF ORNAMENT MOVING ELEMENTS

BACKGROUND OF THE INVENTION

The present invention relates to a double maneuvered music box having a first moving mechanism driven by a clock-work therefor and a Gear on a pinned barrel thereof to swing or rotate a first set of ornamental moving elements, and a second moving mechanism coupled to the shaft of the pinned barrel to move a variety of second sets of ornamental moving elements.

Coventionally, a music box is simply comprised of an apparatus consisted of a pinned barrel and a metal comb, as shown in FIG. 5, that reproduces music mechanically when activated by a clockwork. In order to attract people, a rotary ornament may be used and mounted on a music box. The rotary ornament is rotated when the pinned barrel is turned round and round by the clockwork. Because the rotary ornament can only make a rotary motion when the pinned barrel is rotated, little variation is produced to attract consumers.

SUMMARY OF THE INVENTION

The present invention has been accomplished under the aforesaid circumstances. It is therefore the object of the present invention to provide a music box which drives a variety of ornaments to move in different directions as the music box is activated. It is another object of the present invention to provide a music box having a first moving mechanism driven by the clock-work and a gear on the pinned barrel to swing or rotate a first set of ornamental moving elements. It is still another object of the present invention to provide a music box having a second moving mechanism driven by the shaft of the pinned barrel to swing, rock, reciprocate, oscillate, push and pull, or rotate a second set of ornamental moving elements.

BRIEF DESCRIPTION OF THE DRAWINGS

FIGS. 1 and 1A show a perspective view and partial enlarged exploded view of the internal mechanical structure of a music box constructed according to one embodiment of the present invention;

FIGS. 2 and 2A is a perspective view and partial enlarged exploded view of the internal mechanical structure of a music box constructed according to a second embodiment of the present invention;

DETAILED DESCRIPTION OF THE PREFERRED EMBODIMENTS

Figure 3:
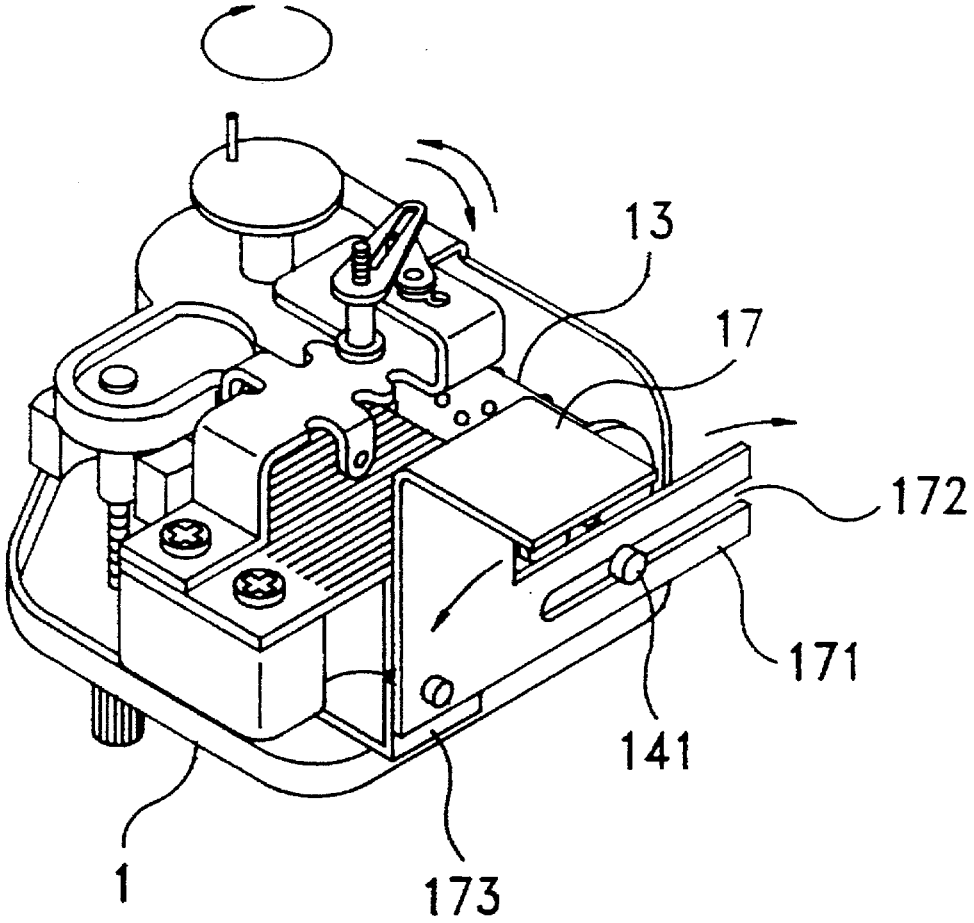
FIG. 3 is a perspective view of still a preferable embodiment of the present invention showing a swinging device coupled to the shaft of the pinned barrel through a cam.

Referring to FIGS. 1 and 1A, the double maneuvered music box 1 comprises a rotary table 10 coupled to the shaft of the clock-work (not shown) thereof at the top, a first bracket 111 formed on a mount 11 at the top above the pinned barrel 13 and having a key hole 112, which receives the shaft 121 of the transmission gear 12 of a first moving mechanism. The transmission gear 12 is engaged with a gear 131 coupled to the pinned barrel 13 at one end. A swivel plate 115 is mounted on the shaft 121 at the top horizontally, having an upright pin 1151 inserted into an elongated slot 118 on a swinging plate 117, which is mounted on a shaft 116 fastened to the mount 11 at the top. As the pinned barrel 13 is rotated by the clock-work, the swivel plate 115 is turned round and round by the shaft 121 of the transmission gear 12, and therefore the swinging plate 117 is driven by the upright pin of the swivel plate 115 to swing horizontally within 120° angle. The swinging angle of the swinging plate 117 is determined according to the length of the elongated slot 118. A cam 14 is coupled to the pinned barrel 13 at an opposite end and rotated to move an ornament (not shown) above. The mount 11 further comprises a second bracket 113 with axle holes 114 for mounting a curved actuating rod, (not shown).

Referring to FIGS. 2 and 2A, a gear 151 has a gear shaft 152 coupled to the shaft 121 of the transmission gear 12 at the top. A rotary table 15 is mounted on She shaft 116, having a pinion (not shown meshed with the gear 151. Therefore, the rotary table 15 is turned round and round by the gear 151 as the pinned barrel 13 is rotated by the clock-work.

Referring to FIG. 3, the second moving mechanism is made in the form of a swinging device comprised of a movable frame 17 pivoted to a bottom plate 173 fastened to the casing of the music box 1 and guided by a projecting rod 141 on the cam 14. The projecting rod 141 inserts in a sliding groove 172 on a horizontal extension plate 171 of the movable frame 17. As the pinned barrel 13 is turned round and round, the movable frame 17 is driven by the projecting rod 141 to oscillate back and forth alternatively, and therefore the ornament (not shown) on the movable frame 17 is synchronously moved.

Figure 4A:
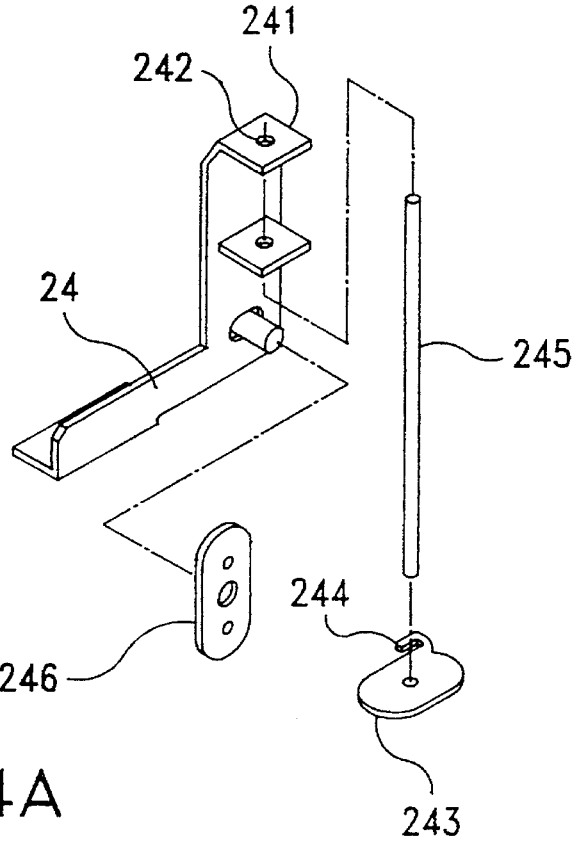
FIGS. 4 and 4A is a perspective and partial exploded view of another alternate form of the present invention showing an upright rod reciprocated by the pinned barrel through a cam.
Figure 4:
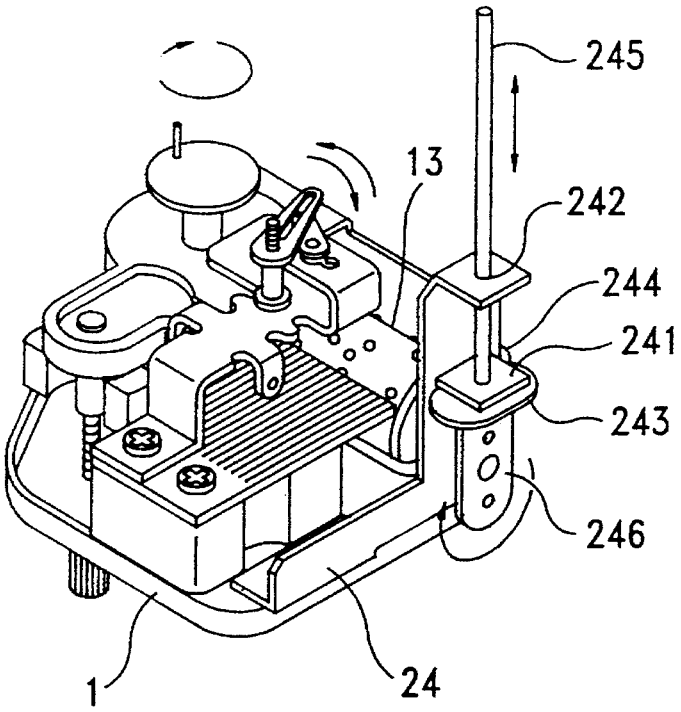
Figure 5:
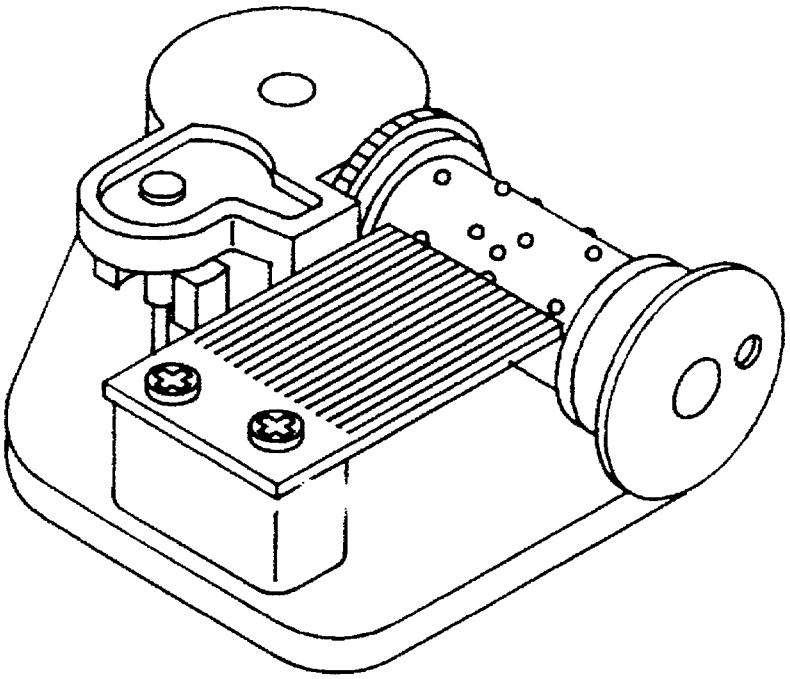
FIG.5 (PRIOR ART)
FIG. 5 is a perspective view of the internal mechanical structure of a conventional music box.

Referring to FIGS. 4 and 4A, the second moving mechanism is a reciprocating device which comprises an angle frame 24 fastened to the casing of the music box at one side and having through holes 242 aligned on two horizontal extension boards 241 thereof, the cam 246 equivalent to 14 in FIG. 1, coupled to the shaft of the pinned barrel 13, a horizontal stop plate 243 fastened to the angle frame 24 by a hook 244 thereof and disposed between the cam 246 and the lower horizontal extension board 241, and a reciprocating rod 245 inserted through the through holes 242 on the horizontal extension boards 241 and fixed to the stop plate 243. Turning on the pinned barrel 13 causes the cam 246 to pushes the stop plate 243 up and down vertically and alternatively, and therefore the ornament mounted on the reciprocating rod 245 is reciprocated vertically.

What is claimed is:

1. A double maneuvered music box having a pinned barrel activated by a clock-work to reproduce music mechanically, the improvement comprising: a rotary table driven by said clock-work, a mount fastened above said pinned barrel, a first bracket formed on top of said mount and having a key hole, a second bracket formed on said mount and having an axle hole, two sets of ornament moving elements to simultaneously move an ornament, including a first moving mechanism and a second moving mechanism, said first moving mechanism mounted on said mount to carry the ornament comprising a transmission gear, a drive gear coupled to said pinned barrel and meshed with said transmission gear, said transmission gear having a gear shaft inserted through said key hole on said first bracket, said second moving mechanism coupled to a shaft of said pinned barrel opposite to said clock-work and driven by said pinned barrel to move the ornament.

2. The music box of claim 1 wherein said first moving mechanism further comprises a swivel plate with an upright pin, a swinging plate with an elongated slot, said swivel plate having one end fastened to said gear shaft of said transmission gear and an opposite end fastened with said upright pin inserted into said elongated slot on said swinging plate mounted on said mount.

3. The music box of claim 1 wherein said second moving mechanism is a cam coupled to said shaft of said pinned barrel.

4. The music box of claim 3 wherein said second moving mechanism comprises an angle frame fastened to a casing of the music box at one side and having through holes aligned on two horizontal extension boards thereof, and coupled to said cam on said shaft of said pinned barrel, a horizontal stop plate having a hook at one side fastened to said angle frame by said hook thereof and disposed between said cam and a lower one of the horizontal extension boards, and a reciprocating rod inserted through the holes on said horizontal extension boards and fixed to said stop plate.

* * * * *